US006433624B1

(12) United States Patent
Grossnickle et al.

(10) Patent No.: US 6,433,624 B1
(45) Date of Patent: Aug. 13, 2002

(54) THRESHOLD VOLTAGE GENERATION CIRCUIT

(75) Inventors: Vaughn J. Grossnickle, Hillsboro; Siva G. Narendra; Vivek K. De, both of Beaverton, all of OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/727,176

(22) Filed: Nov. 30, 2000

(51) Int. Cl.[7] ..... G05F 1/10
(52) U.S. Cl. ..... 327/543
(58) Field of Search ..... 323/312, 313, 323/314, 315, 316; 327/530, 534, 535, 537, 538, 540, 541, 543

(56) References Cited

U.S. PATENT DOCUMENTS

| | | | | | |
|---|---|---|---|---|---|
| 4,342,926 | A | | 8/1982 | Whatley | 307/297 |
| 4,461,991 | A | | 7/1984 | Smith | 323/312 |
| 5,300,837 | A | * | 4/1994 | Fischer | 307/491 |
| 5,619,164 | A | * | 4/1997 | Tomishima | 327/541 |
| 5,654,665 | A | * | 8/1997 | Menon et al. | 327/541 |
| 5,703,497 | A | * | 12/1997 | Min | 326/33 |
| 5,894,236 | A | * | 4/1999 | Mizoguchi et al. | 327/108 |
| 5,903,141 | A | | 5/1999 | Tailliet | 323/312 |
| 5,914,868 | A | * | 6/1999 | Han et al. | 363/60 |
| 5,939,933 | A | | 8/1999 | Wang | 327/512 |
| 6,188,270 | B1 | | 2/2001 | Boerstler | 327/543 |

* cited by examiner

*Primary Examiner*—Jeffrey Zweizig
(74) *Attorney, Agent, or Firm*—Schwegman, Lundberg, Woessner & Kluth, P.A.

(57) ABSTRACT

A threshold voltage generation circuit includes a control transistor, one or more load transistors, and a current mirror. The load transistors are diode-connected transistors that are operated in saturation. The source-to-gate voltage of the load transistors approximates the threshold voltage of the transistors over process and temperature. The operation of the circuit is affected by choosing a bias voltage for the control transistor, the sizes of the control transistor and load transistors, and the ratio of transistor sizes within the current mirror.

28 Claims, 3 Drawing Sheets

THRESHOLD VOLTAGE GENERATION CIRCUIT

FIELD

The present invention relates generally to voltage reference generation circuits, and more specifically to the generation of voltages related to transistor threshold voltages.

BACKGROUND

Metal oxide semiconductor (MOS) transistors have a "threshold voltage" (Vt) that can change as a result of process and temperature variations. Process variations occur during manufacture of the MOS transistor, and temperature variations occur as the MOS transistor is operating.

When the voltage across two terminals of the MOS transistor is below the threshold voltage, the MOS transistor is off. When the voltage across the terminals increases to the threshold voltage, the MOS transistor turns on, and begins to conduct current. When the voltage increases much beyond the threshold voltage, the MOS transistor can operate in "saturation."

Some circuits can benefit from receiving a voltage that is equal or nearly equal to a threshold voltage of a MOS transistor. Some circuits can also benefit from receiving a voltage that is a function of the threshold voltage of a MOS transistor. If a fixed voltage is provided to the circuit, problems can arise in part because the threshold voltage of the MOS transistor changes over process and temperature, and the desired relationship between the threshold voltage of the MOS transistor and the received voltage is not maintained.

For the reasons stated above, and for other reasons stated below which will become apparent to those skilled in the art upon reading and understanding the present specification, there is a need in the art for a method and apparatus that can generate voltages that are related to threshold voltages over process and temperature variations.

DESCRIPTION OF EMBODIMENTS

Figure 1:
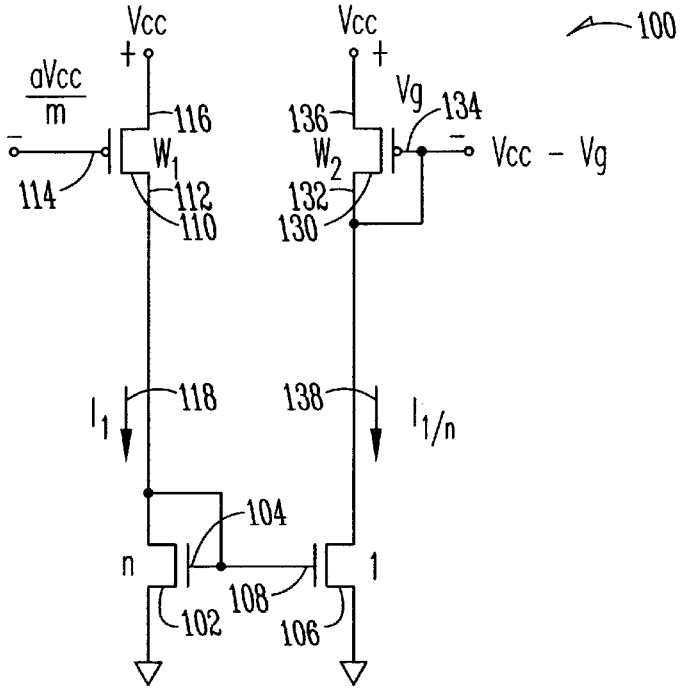
FIG. 1 shows a first threshold voltage generation circuit.

In the following detailed description of the embodiments, reference is made to the accompanying drawings which show, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

The method and apparatus of the present invention provide a mechanism to generate voltages related to threshold voltages of MOS transistors. A current mirror provides a current to diode-connected load transistors that operate in saturation. The current is chosen such that the source-to-gate voltage ($V_{sg}$) of the diode-connected load transistors is a voltage that approximates the threshold voltage. As the threshold voltage of the diode-connected transistors changes as a result of process or temperature changes, the $V_{sg}$ of the diode-connected transistors also changes. Integer multiples of the threshold voltage can be generated by cascading diode-connected transistors in series, and non-integer multiples can be generated with buffers and voltage dividing circuits. Example circuits are presented that sense the threshold voltage of p-channel transistors. Other embodiments exist that sense the threshold voltage of n-channel transistors.

FIG. 1 shows a first threshold voltage generation circuit. Threshold voltage generation circuit 100 includes MOS transistors 102, 106, 110, and 130. Transistors 102 and 108 are n-channel transistors that form a current mirror. Transistors 110 and 130 are p-channel transistors. Transistor 110 is referred to as a "control" transistor, and transistor 130 is referred to as a "load" transistor. Control transistor 110 determines the current that controls operation of the current mirror. Through the action of the current mirror, control transistor 110 also determines the current that flows through load transistor 130.

In some embodiments, transistors 102, 106, 110, and 130 are "long channel" devices. A long channel device is one that has a channel from source-to-drain that is longer than the minimum dimension for the process in which it is manufactured. In general, longer channel length allows for simpler design in part because the transistor behavior more closely approximates a theoretical behavior described below. Short channel devices can also be used. When short channel devices are used, circuit analysis can become more complicated in part because certain assumptions cannot be made. The analysis of the circuit with long channel devices is provided below.

Figure 3:
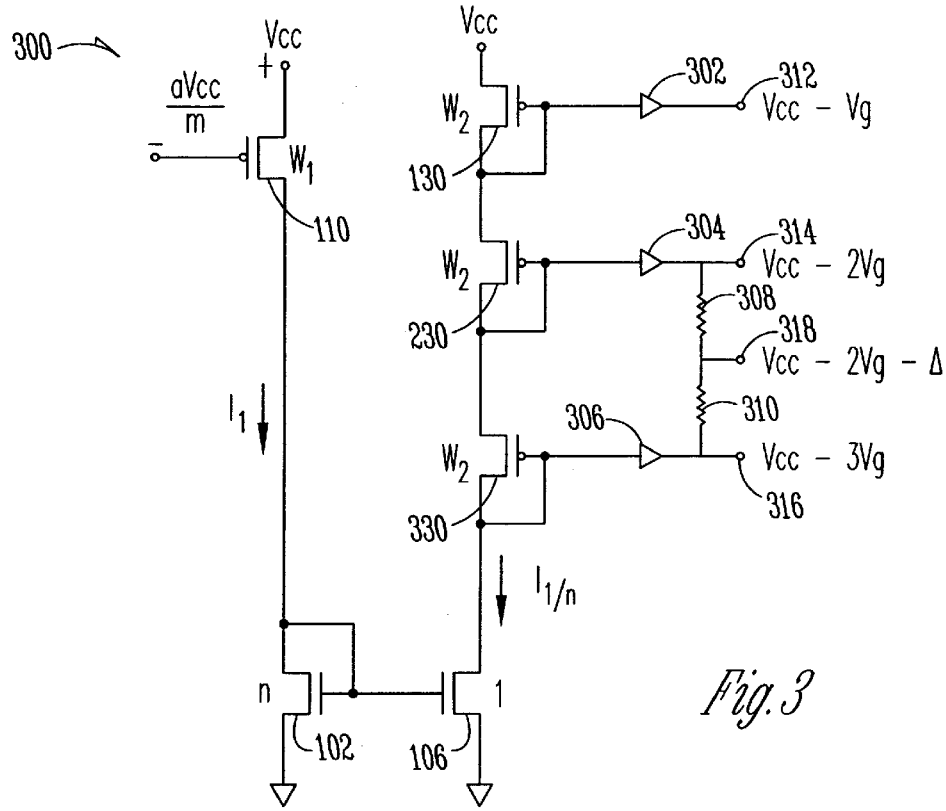
FIG. 3 shows a third threshold voltage generation circuit.
Figure 4:
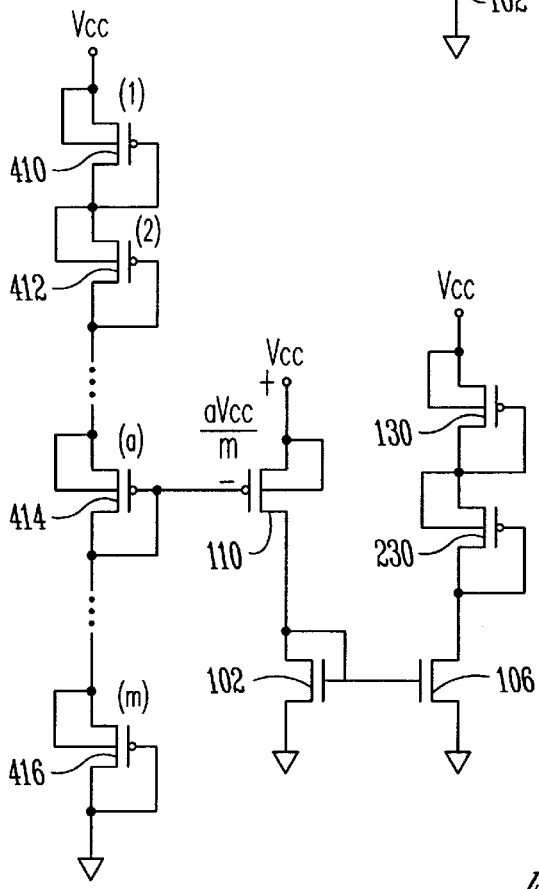
FIG. 4 shows a threshold voltage generation circuit with a control voltage generation circuit.

Transistor 110 includes source 116, drain 112, and gate 114. Source 116 is coupled to an upper supply voltage node, shown as $V_{cc}$ in FIG. 1. Drain 112 is coupled to transistor 102 of the current mirror. Gate 114 is coupled to a node that provides a $V_{sg}$ substantially equal to $aV_{cc}/m$, where a/m is a constant. The voltage on gate 114 can be provided by a bias circuit or "control voltage generation" circuit, examples of which are shown in FIGS. 3 and 4. The value for a/m is chosen using criteria discussed more fully below. For long channel transistors, the source-to-drain current through transistor 110 is given by:

$$I_1 = k\frac{W_1}{L}\left(\frac{aV_{cc}}{m} - V_t\right)^2 \tag{1}$$

where $W_1$ is the channel width and L is the channel length of transistor 110. $V_t$ is the threshold voltage of transistor 110, and $aV_{cc}/m$ is the voltage imposed from the source to the gate of transistor 110. "k" is a well known constant that is a function of the mobility of the majority carriers and the oxide capacitance of the transistor.

Transistor 102 is shown in FIG. 1 having size "n," and transistor 106 is shown having size "1." This creates a current ratio of 1/n for the current mirror made up from transistors 102 and 106. For example, current 118 conducts from drain to source in transistor 102 and has a value of $I_1$, and current 138 conducts from drain to source in transistor 106 and has a value of $I_1/n$. Current 118 is referred to as the "control" current.

Transistor 130 includes source 136, drain 132, and gate 134. Source 136 is coupled to an upper supply voltage node, shown as $V_{cc}$ in FIG. 1. Drain 132 is coupled to transistor 106 of the current mirror. Gate 134 is coupled to drain 132, and therefore, transistor 130 is referred to as a "diode-connected" transistor. The source-to-drain current is set by the current mirror, and the value of the source-to-drain current in transistor 130 is $I_1/n$. The source-to-drain current through transistor 130 is given by:

$$\frac{I_1}{n} = k\frac{W_2}{L}(V_g - V_t)^2 \tag{2}$$

where $W_2$ is the channel width and L is the channel length of transistor 130. $V_t$ is the threshold voltage of transistor 130, and $V_g$ is the voltage on the gate of transistor 130.

Though it is not a requirement, we can assume that the length of transistors 110 and 130 are the same. Making this assumption, combining equations (1) and (2) and solving for $V_g$ yields $$V_g = V_t + \sqrt{\frac{W_1}{nW_2}}\left(\frac{aV_{cc}}{m} - V_t\right) \tag{3}$$

Equation (3) shows that the source-to-gate voltage on transistor 130 is the sum of two voltage terms. The first of the voltage terms is the threshold voltage of transistor 130. The second of the voltage terms is a function of the channel widths of transistors 110 and 130, and also is a function of the difference between the source-to-gate voltage ($aV_{cc}/m$) and the threshold voltage ($V_t$) of transistor 110. If the second voltage term is near zero, then the source-to-gate voltage on transistor 130 approaches the threshold voltage of the transistor. The voltage on the gate of transistor 130 is equal to $V_{cc}-V_g$.

In some embodiments, the value of "a/m" is chosen such that $aV_{cc}/m-V_t$ approaches zero. This makes the second voltage term of equation (3) also approach zero. In some embodiments, $nW_2$ is chosen to be much larger than $W_1$. This makes the square root term approach zero, which in turn makes the second voltage term approach zero. These embodiments result in the gate voltage on transistor 130 being an approximation of the threshold voltage ($V_t$).

The equations presented above assume that transistors 110 and 130 are in saturation. As a result, the second voltage term in equation (3) cannot go all the way to zero, because the gate voltage needs to be somewhat larger than the threshold voltage in order for the transistor to be on. The transistor must be on for the transistor to be in saturation. The second voltage term of equation (3), however, can be made very small and still maintain transistor 130 in saturation.

As the threshold voltage of transistor 130 varies over process and temperature, the source-to-gate voltage of transistor 130 tracks it. As transistor 130 becomes hotter and the threshold voltage becomes smaller, the source-to-gate voltage will also become smaller, and vice versa.

The threshold voltage generation circuit of FIG. 1 can be used for many purposes. Any circuit that benefits from a voltage that tracks the threshold voltage of the transistor can benefit from the use of threshold voltage generation circuit 100.

Figure 2:
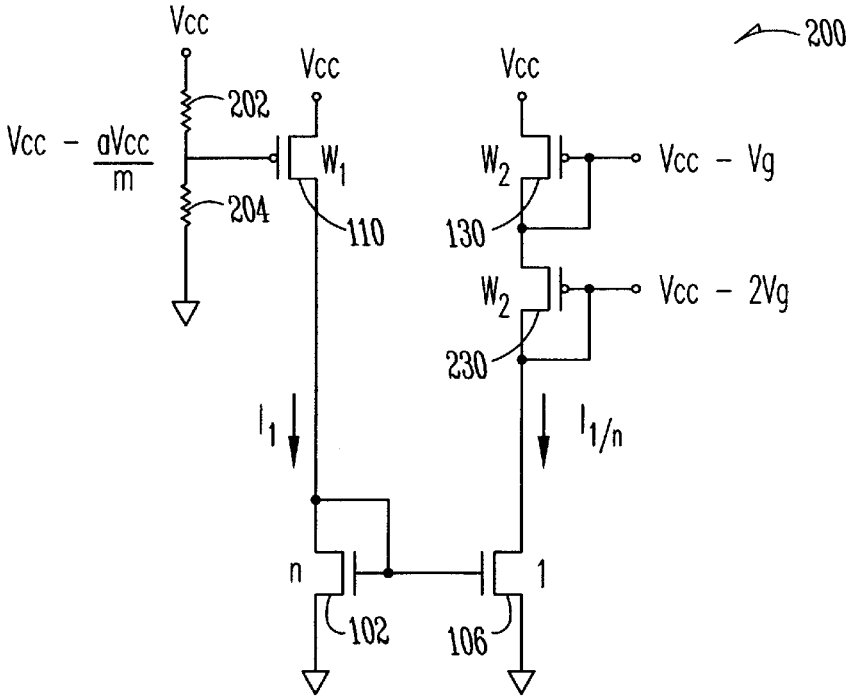
FIG. 2 shows a second threshold voltage generation circuit.

FIG. 2 shows a second threshold voltage generation circuit. Threshold voltage generation circuit 200 includes transistors 102, 106, 110, and 130. Threshold voltage generation circuit 200 also includes load transistor 230 coupled in series with load transistor 130. Transistor 230 is a diode-connected transistor that operates in the same manner as transistor 130, and the source-to-gate voltage on transistor 230 approximates the threshold voltage of the transistor. Any number of diode-connected transistors can be coupled in series in the fashion shown in FIG. 2.

Threshold voltage generation circuit 200 generates two voltages that are a function of the transistor threshold voltage. The gate of transistor 130 produces a voltage of $V_{cc}-V_g$, and the gate of transistor 230 produces a voltage of $V_{cc}-2V_g$. $V_g$ is a function of the transistor threshold voltage as described above with reference to equation (3).

Threshold voltage generation circuit 200 also includes a voltage divider circuit that includes resistors 202 and 204. The voltage divider circuit is used to present a voltage of $aV_{cc}/m$ on the gate of control transistor 110 as described above with reference to FIG. 1. Any type of circuit can be used to generate the voltage of $aV_{cc}/m$, and the invention is not limited to the use of a voltage divider as shown. For example, FIG. 4 shows another circuit that can be used to generate the voltage of $aV_{cc}/m$.

FIG. 3 shows a third threshold voltage generation circuit. Threshold voltage generation circuit 300 includes three diode-connected transistors in series: transistors 130, 230, and 330. The gate of each of the diode-connected transistors drives a buffer that isolates the threshold voltage generation circuit from any circuits that utilize the voltages generated by circuit 300. For example, voltage generation circuit 300 includes buffers 302, 304, and 306, coupled to transistors 130, 230, and 330, respectively. In some embodiments, buffers 302, 304, and 306 are high-input-impedance buffers that do not draw current from voltage generation circuit 300.

Output node 312 of buffer 302 has a voltage of $V_{cc}-V_g$, output node 314 of buffer 304 has a voltage of $V_{cc}-2V_g$, and output node 316 of buffer 306 has a voltage of $V_{cc}-3V_g$. An additional output node 318 is created by a voltage divider between output nodes 314 and 316. The voltage divider is made up of resistors 308 and 310. Output node 318 has a voltage between the voltages on output nodes 314 and 316, shown in FIG. 3 as $V_{cc}-2\ V_g-\Delta$.

Threshold voltage generation circuit 300 generates voltages that are integer multiples of source-to-gate voltages and non-integer multiples of source-to-gate voltages. The source-to-gate voltages change as the threshold voltage of the transistors change, and in some embodiments, the source-to-gate voltages are very close to the threshold voltages.

One non-integer multiple voltage is shown on output node 318. Any number of non-integer multiple voltages can be created in this manner. The embodiment of FIG. 3 shows a resistive voltage divider used to create the voltage on output node 318. In other embodiments, other types of circuits are used to generate non-integer multiples of source-to-gate voltages.

FIG. 4 shows a threshold voltage generation circuit with a control voltage generation circuit. The control voltage generation circuit includes "m" p-channel transistors, shown as p-channel transistors 410, 412, 414, and 416 in FIG. 4. The "m" p-channel transistors are coupled in series between $V_{cc}$ and ground, and each is diode connected. Transistor 414 is shown schematically as transistor "a" in the series of "m" transistors, and the voltage on the gate of transistor 414 is $aV_{cc}/m$.

The p-channel transistors in the threshold voltage generation circuit and control voltage generation circuit of FIG. 4 are shown with the transistor body tied to the transistor source. This can be useful in some processes, such as n-well processes, in part because body effects can be reduced. Any of the transistors in any of the embodiments can be so connected.

FIGS. 1–4 show threshold voltage generation circuits that have n-channel current mirrors and p-channel control and load transistors. The output voltages are a function of the threshold voltages of the p-channel transistors. In other embodiments, a p-channel current mirror and n-channel control and load transistors are used. In these embodiments, the output voltages are a function of the threshold voltages of the n-channel transistors. Any number of integer multiples and non-integer multiples of n-channel transistor gate-to-source voltages can be generated in these embodiments.

Figure 5:
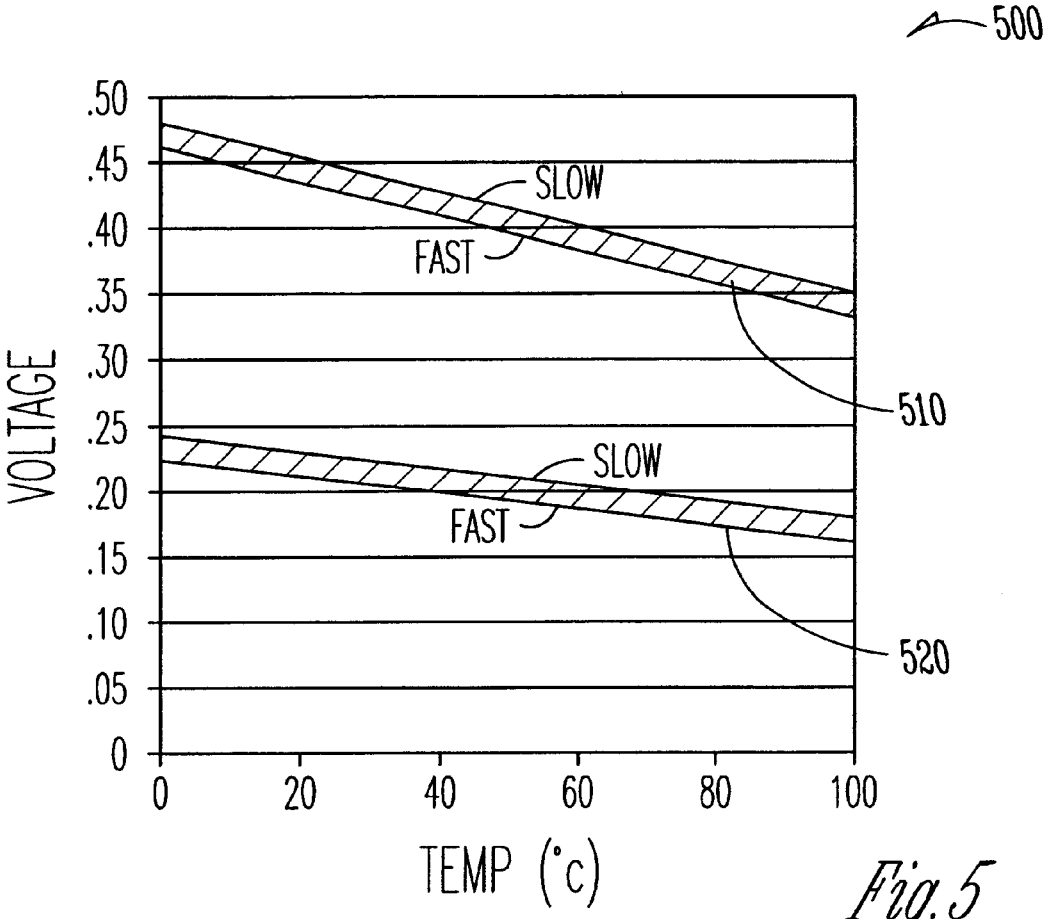
FIG. 5 shows a graph of simulation results.

FIG. 5 shows a graph of simulation results. Graph 500 shows two curves that vary over process and temperature. Curve 510 represents the source-to-gate voltage of transistor 230 (FIG. 2), and curve 520 represents the voltage from the source of transistor 130 to the gate of transistor 230 (FIG. 2). The width of curves 510 and 520 represents the variation over process: the top of the curve representing process variations that result in slower transistors; and the bottom of the curve representing process variations that result in faster transistors.

The simulation results show that the voltages generated by the various embodiments of the present invention vary substantially linearly with temperature variations, and track threshold voltages over temperature and process. At all temperature points in graph 500, the value of curve 510 is substantially twice that of curve 520.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A voltage reference circuit comprising:

a current mirror to generate a second current as a function of a first current;

a diode-connected transistor in the path of the second current to generate a voltage substantially equal to one threshold voltage; and a second diode-connected transistor in the path of the second current to generate a voltage substantially equal to two threshold voltages.

2. The voltage reference circuit of claim 1 further comprising a control transistor in the path of the first current to influence a magnitude of the first current.

3. The voltage reference circuit of claim 2 wherein the current mirror includes:

a first n-channel transistor in the path of the first current, the first n-channel transistor having a first size; and a second n-channel transistor in the path of the second current, the second n-channel transistor having a second size, wherein a ratio of the second size to the first size is equal to 1/n, such that a magnitude of the second current is substantially equal to the magnitude of the first current divided by n.

4. The voltage reference circuit of claim 3 wherein the control transistor in the path of the first current comprises a p-channel transistor having:

a source coupled to a voltage supply node configured to have a voltage of $V_{cc}$;

a drain coupled to the first n-channel transistor; and a gate coupled to a node having a voltage set to substantially $aV_{cc}/m$, where a/m is a constant.

5. The voltage reference circuit of claim 4 wherein the control transistor has a width $W_1$ and the diode-connected transistor has a width $W_2$, such that n times $W_2$ is substantially larger than $W_1$.

6. The voltage reference circuit of claim 4 wherein $aV_{cc}/m$ is substantially equal to a threshold voltage of the control transistor.

7. The voltage reference circuit of claim 4 wherein $aV_{cc}/m$ is slightly larger than a threshold voltage of the control transistor.

8. The voltage reference of claim 4 wherein the control transistor has a width $W_1$ and the diode-connected transistor has a width $W_2$, such that a source-to-gate voltage of the diode-connected transistor substantially satisfies the equation $$V_g = V_t + \sqrt{\frac{W_1}{nW_2}}\left(\frac{aV_{cc}}{m} - V_t\right)$$

wherein $V_g$ is the source-to-gate voltage of the diode-connected transistor, and $V_t$ is the threshold voltage of the diode-connected transistor.

9. The voltage reference circuit of claim 1 further comprising a buffer circuit coupled to a gate of the diode-connected transistor.

10. The voltage reference circuit of claim 1 further comprising a voltage divider coupled to a gate of the diode-connected transistor to generate a voltage substantially equal to a non-integer multiple of a threshold voltage.

11. A voltage reference circuit comprising:

a first diode-connected transistor having a size and a current therethrough; and a current source to provide the current, wherein the current is large enough to keep the first diode-connected transistor in a region of saturation, such that a gate voltage of the first diode-connected transistor is equal to a threshold voltage plus a voltage that is a function of the size of the first diode-connected transistor;

wherein the current source comprises a current mirror to produce the current as a function of a control current, and a p-channel transistor to set the control current;

wherein the p-channel transistor comprises a source coupled to a voltage supply node configured to have a voltage of $V_{cc}$, a drain coupled to the current mirror, and a gate coupled to a node configured to have a voltage substantially equal to $aV_{cc}/m$, where a/m is a constant; and wherein the p-channel transistor has a width $W_1$, the current mirror has a current ratio of 1/n, and the first diode-connected transistor has a width $W_2$, wherein the gate voltage of the first diode-connected transistor substantially satisfies the equation $$V_g = V_t + \sqrt{\frac{W_1}{nW_2}}\left(\frac{aV_{cc}}{m} - V_t\right)$$

wherein $V_g$ is the source-to-gate voltage of the first diode-connected transistor, and $V_t$ is the threshold voltage of the first diode-connected transistor.

12. The voltage reference of claim 11 wherein the ratio of $W_1$ to $nW_2$ is near zero such that $V_g$ is substantially equal to $V_t$.

13. The voltage reference of claim 11 wherein $aV_{cc}/m-V_t$ is near zero such that $V_g$ is substantially equal to $V_t$.

14. A voltage reference circuit comprising:

a first diode-connected transistor having a size and a current therethrough;

a current source to provide the current, wherein the current is large enough to keep the first diode-connected transistor in a region of saturation, such that a gate voltage of the first diode-connected transistor is equal to a threshold voltage plus a voltage that is a function of the size of the first diode-connected transistor; and a second diode-connected transistor coupled between the first diode-connected transistor and the current mirror such that a gate voltage of the second diode-connected transistor is substantially one threshold voltage different from the gate voltage of the first diode-connected transistor.

15. The voltage reference circuit of claim 14 further comprising:

a voltage divider circuit coupled between the gate of the first diode-connected transistor and the gate of the second diode-connected transistor to generate a voltage that includes a fractional threshold voltage component.

16. The voltage reference circuit of claim 14 further comprising a control transistor to provide a control current to the current source, wherein the control transistor has a width $W_1$ and the first diode-connected transistor has a width $W_2$, such that the relationship between $W_2$ and $W_1$ influences a source-to-gate voltage of the first diode-connected transistor.

17. An integrated circuit comprising:

a p-channel control transistor to generate a control current;

a current mirror to create a second current from the control current;

at least one diode-connected p-channel transistor coupled to the current mirror to generate a gate voltage substantially equal to one transistor threshold voltage; and a bias circuit coupled to the p-channel transistor to bias the p-channel transistor such that the control current passes therethrough, wherein the bias circuit comprises a voltage divider circuit.

18. The integrated circuit of claim 17 wherein the p-channel control transistor has a width $W_1$ and the at least one diode-connected p-channel transistor has a width $W_2$, such that the relationship between $W_2$ and $W_1$ influences a source-to-gate voltage of the at least one diode-connected p-channel transistor.

19. The integrated circuit of claim 18 wherein the current mirror includes:

a first n-channel transistor in the path of the control current, the first n-channel transistor having a first size; and a second n-channel transistor in the path of the second current, the second n-channel transistor having a second size, wherein a ratio of the second size to the first size is equal to 1/n, such that a magnitude of the second current is substantially equal to the magnitude of the control current divided by n.

20. The integrated circuit of claim 19 wherein the p-channel control transistor comprises:

a source coupled to a voltage supply node configured to have a voltage of $V_{cc}$;

a drain coupled to the first n-channel transistor; and a gate coupled to the bias circuit to provide a voltage substantially equal to $aV_{cc}/m$, where a/m is a constant.

21. The integrated circuit of claim 20 wherein the p-channel control transistor has a width $W_1$ and the at least one diode-connected p-channel transistor has a width $W_2$, such that n times $W_2$ is substantially larger than $W_1$.

22. A circuit comprising:

a current mirror to generate a second current substantially equal to a first current divided by n;

a diode-connected transistor in the path of the second current; and a control transistor in the path of the first current;

wherein the control transistor has a width $W_1$ and the diode-connected transistor has a width $W_2$, such that n times $W_2$ is substantially larger than $W_1$.

23. The circuit of claim 22 further comprising a second diode-connected transistor in the path of the second current to generate a voltage substantially equal to two threshold voltages.

24. The circuit of claim 22 wherein the current mirror includes:

a first n-channel transistor in the path of the first current, the first n-channel transistor having a first size; and a second n-channel transistor in the path of the second current, the second n-channel transistor having a second size, wherein a ratio of the second size to the first size is equal to 1/n.

25. The circuit of claim 24 wherein the control transistor in the path of the first current comprises a p-channel transistor having:

a source coupled to a voltage supply node configured to have a voltage of $V_{cc}$;

a drain coupled to the first n-channel transistor; and a gate coupled to a node having a voltage set to substantially $aV_{cc}/m$, where a/m is a constant.

26. The circuit of claim 25 wherein $aV_{cc}/m$ is substantially equal to a threshold voltage of the control transistor.

27. The circuit of claim 25 wherein $aV_{cc}/m$ is slightly larger than a threshold voltage of the control transistor.

28. A voltage reference circuit comprising:

a current mirror to generate a second current as a function of a first current;

a diode-connected transistor in the path of the second current to generate a voltage substantially equal to one threshold voltage; and a control transistor in the path of the first current to influence a magnitude of the first current;

wherein the current mirror includes a first n-channel transistor in the path of the first current, the first n-channel transistor having a first size, and a second n-channel transistor in the path of the second current, the second n-channel transistor having a second size, wherein a ratio of the second size to the first size is equal to 1/n, such that a magnitude of the second current is transistor having a source coupled to a voltage supply node configured to have a voltage of $V_{cc}$, a drain coupled to the first n-channel transistor, and a gate coupled to a node having a voltage set to substantially $aV_{cc}/m$, where a/m is a constant; and wherein the control transistor has a width $W_1$ and the diode-connected transistor has a width $W_2$, such that n times $W_2$ is substantially larger than $W_1$.

* * * * *

UNITED STATES PATENT AND TRADEMARK OFFICE

CERTIFICATE OF CORRECTION

PATENT NO. : 6,433,624 B1 
DATED : August 13, 2002
INVENTOR(S) : Vaughn J. Grossnickle, Siva G. Narendra and Vivek K. De It is certified that error appears in the above-identified patent and that said Letters Patent is hereby corrected as shown below:

Column 8,
Line 58, insert -- substantially equal to the magnitude of the first current divided by n; wherein the control transistor in the path of the first current comprises a p-channel -- after "is".

Signed and Sealed this

First Day of April, 2003

JAMES E. ROGAN
*Director of the United States Patent and Trademark Office*